US006886757B2

(12) United States Patent
Byrnes et al.

(10) Patent No.: US 6,886,757 B2
(45) Date of Patent: May 3, 2005

(54) NOZZLE ASSEMBLY FOR HVOF THERMAL SPRAY SYSTEM

(75) Inventors: Larry Edward Byrnes, Rochester Hills, MI (US); Leslie K. Sumner, Lapeer, MI (US); Peter J. Toth, Franklin, TN (US); Martin Stephen Kramer, Clarkston, MI (US); William L. Oberkampf, Albuquerque, NM (US); Richard Earl Teets, Bloomfield Hills, MI (US); Charles D. Valerius, II, Grosse Pointe Woods, MI (US)

(73) Assignees: General Motors Corporation, Detroit, MI (US); Sandia National Laboratories, Albuquerque, NM (US)

( * ) Notice: Subject to any disclaimer, the term of this patent is extended or adjusted under 35 U.S.C. 154(b) by 314 days.

(21) Appl. No.: 10/081,913

(22) Filed: Feb. 22, 2002

(65) Prior Publication Data

US 2003/0160109 A1 Aug. 28, 2003

(51) Int. Cl.[7] ..... B05B 1/24; B05B 7/10
(52) U.S. Cl. ..... 239/84; 239/400
(58) Field of Search ..... 239/84, 85, 79, 239/400; 219/121.47, 121.51, 76.16

(56) References Cited

U.S. PATENT DOCUMENTS

| | | | |
|---|---|---|---|
| 5,014,916 A | 5/1991 | Trapani et al. | 239/85 |
| 5,148,986 A | 9/1992 | Rusch | 239/85 |
| 5,271,967 A | 12/1993 | Kramer et al. | 427/455 |
| 5,275,336 A | 1/1994 | Stasi et al. | 239/84 |
| 5,380,564 A | 1/1995 | VanKuiken, Jr. et al. | 427/456 |
| 5,592,927 A | 1/1997 | Zaluzec et al. | 123/668 |
| 5,626,674 A | 5/1997 | VanKuiken, Jr. et al. | 118/317 |
| 5,820,938 A | 10/1998 | Pank et al. | 427/449 |

FOREIGN PATENT DOCUMENTS

GB 2111420 A * 7/1983 ..... B23K/7/06

OTHER PUBLICATIONS

Hong et al, "Impurity Effects on Adhesion: Nb, C, O, B, and S at a Mo/$MoSi_2$ Interface," *Physical Review B*, vol. 47, No. 20, May 15, 1993, pp. 13 615–13 625.

Rabiei et al, "Microstructure, Deformation and Cracking Characteristics of Thermal Spray Ferrous Coatings," *Materials Science and Engineering A269* , 1999, pp. 152–165.

Sigler, "Adherence Behavior of Oxide Grown in Air and Synthetic Exhaust Gas on Fe–Cr–Al Alloys Containing Strong Sulfide–Forming Elements: Ca, Mg, Y, Ce, La, Ti, and Zr," *Oxidation of Metals*, vol. 40, Nos. 5/6, 1993, pp. 555–583.

* cited by examiner

*Primary Examiner*—Chen Wen Jiang
(74) *Attorney, Agent, or Firm*—Cary W. Brooks

(57) ABSTRACT

A nozzle assembly for a HVOF thermal metallic spray coating system includes an inner tube, a middle tube and an outer tube which are concentrically arranged about an axis of the nozzle assembly and are spaced to provide annular, concentric gas flow passages for oxygen and gaseous fuel along with a central wire feed passage in an efficient, compact arrangement. A slotted nib and plug are fitted to the discharge end at the assembly and defined, together with the middle tube, an annular premix chamber for the combustible gases, and a plurality of circumferentially spaced mixing slots and a downstream mix end portion of the nib where complete mixing of the gases occurs prior to entry into the combustion chamber provided in an air cap. An annular passage between the air cap and outer tube communicates with a high pressure air source for establishing an envelope of air against the inside surface of the air cap to serve as a protective barrier layer from the atomized metal.

7 Claims, 4 Drawing Sheets

NOZZLE ASSEMBLY FOR HVOF THERMAL SPRAY SYSTEM

The invention claimed in this application was made under Government Contract No. CRADA SC92/1104, in which the government may have rights.

TECHNICAL FIELD

This invention relates generally to high velocity oxygen-fuel (HVOF) thermal spray metallic coating systems, and more particularly to the construction of the nozzle.

BACKGROUND OF THE INVENTION

High velocity oxygen-fuel (HVOF) thermal spray torches are known for use in applying a metallic coating to the cylinder bores of an engine block. See, for example, U.S. Pat. Nos. 5,014,916 and 5,080,056. Part of the HVOF system of the type which the invention is concerned is the nozzle. The nozzle serves to guide a feed wire to a high temperature, high velocity combustion zone developed by a high velocity mixture of oxygen and gaseous fuel. The gases are fed through the nozzle and are combusted in the combustion zone which melts the tip of the feed wire. The molten material is subsequently atomized as it is discharged from the torch at high velocity against the walls of the cylinder bores.

Commercially-available nozzles for such HVOF wire feed systems use either a fully mixed flow of oxygen and fuel that is directed into the combustion chamber where it is burned (fully mixed), or provide separate flows of oxygen and fuel that are introduced into the combustion chamber where mixing of the gases and ignition occur simultaneously (external mixing type). While the fully mixed-type nozzle produces a desirable high temperature flame, such an arrangement is subject to flashback wherein combustion propagates from the combustion chamber up the nozzle and into the mixing chamber where it is prone to damaging seals and other hardware of the nozzle. The external mixing type of nozzle avoids the problem of flashback, but at the expense of performance. The simultaneous mixing and combustion of the individually delivered gases operates at a lower temperature and consumes the feed wire at a lower rate, decreasing the deposition rate of the material.

Another drawback to known HVOF systems is that the package size of the nozzle is fairly bulky due to the arrangement of the gas delivery tubes and wire feed tube, which must be dealt with when coating cylinder bores, and in some cases could limit its application based on size.

SUMMARY OF THE INVENTION

A nozzle assembly constructed according to the invention for an HVOF thermal metallic spray coating system comprises an inner tube extending along an axis and defining a feed passage for a feed wire of metallic spray coating material. An outer tube is disposed concentrically about the inner tube. An intermediate tube is disposed concentrically between the inner and outer tubes and defines annular axially extending concentric gas flow passages in the space between the tube walls for the flow of oxygen and fuel.

The concentric arrangement of the tubes provides a very compact, efficient construction for handling the flow of the combustion gases and feed material and enables improved control of the mixing and combustion of the oxygen and fuel gases in a manner that minimizes the problem of flashbacks associated with prior mixed-type nozzles, yet delivers the efficiency and performance of such mixed-type nozzles.

According to a further aspect of the invention, the inner tube is fitted at its end with a slotted nib that cooperates with a plug fitted to the outer tube to define a plurality of slotted mixing chambers. According to this further aspect, the intermediate tube extends over an upper end portion of the nib, whereby the oxygen and gaseous fuel are kept separate until the oxygen is directed into the slots of the nib, where quick, efficient mixing of the gases occur such that the gases exiting the slots of the nib and entering the combustion zone are fully mixed. Such a nozzle construction enables precise control over the mixture of the gases and serves to eliminate or greatly minimize occurrence of flashback, since the flame can travel no further than the slots due to the incomplete noncombustible mixing of the gases in the upper end of the slots. The geometry of the slots and the velocity of gas flow through the slots also prevents formation of mixed pockets of gases which would hold the flame.

BRIEF DESCRIPTION OF THE DRAWINGS

These and other features and advantages of the present invention will become more readily appreciated when considered in connection with the following detailed description and appended drawings, wherein.

DESCRIPTION OF THE PREFERRED EMBODIMENT

Figure 1:
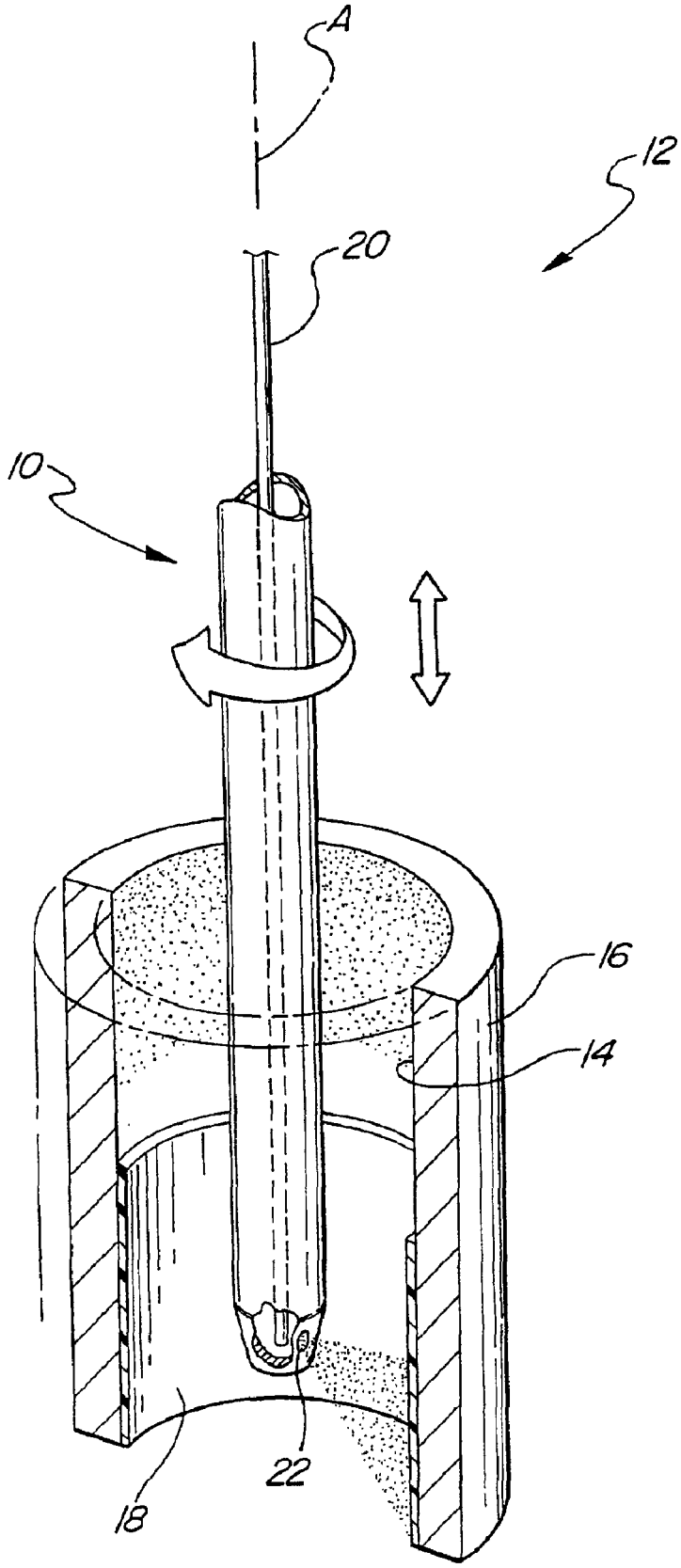
FIG. 1 is a schematic perspective view of an HVOF system for coating cylinder bores of an engine block.

A nozzle assembly 10 constructed according to a presently preferred embodiment of the invention forms part of an overall high velocity oxygen-fuel (HVOF) thermal spray metallic coating apparatus 12 which is schematically illustrated in FIG. 1 and is used to coat the cylinder bore wall surfaces 14 of an engine block 16 with a thin layer 18 of thermally sprayed metal to impart a wear-resistant running surface to the cylinder bores 14.

A feed wire 20 used in making the coating layer 18 is fed down through the nozzle assembly 10 toward a combustion chamber where a mixture of oxygen and gaseous fuel is supplied to melt and atomize the tip end of the feed wire which is then expelled at high velocity in a radial outward direction through an opening 22 in an air cap 24 while the air cap 24 is rotated about a longitudinal axis A of the assembly 10 and while the assembly 10 is reciprocated along its axis with the air cap 24 extended into the cylinder bore 14 to develop the coating layer 18 on the bores 14.

The invention is particularly concerned with the construction and operation of the nozzle assembly 10. As shown best in FIGS. 2 and 3, the nozzle assembly 10 includes an inner tube 26 disposed about the axis A, an intermediate or middle tube 28 disposed concentrically about the inner tube 26, and an outer tube 30 disposed concentrically about the intermediate tube 28, such that the tubes 26, 28, 30 all share the common axis A.

The inner tube 26 defines a central passage 32 concentric with the axis A which is open at a receiving end 34 of the inner tube 26 to receive the feed wire 20 into the passage 32 such that the feed wire 20 extends along the axis A in concentric relationship to the tubes 26, 28, 30.

The intermediate tube 28 has an inner surface which is preferably cylindrical and is spaced radially outwardly from an outer and preferably cylindrical surface of the inner tube 26 to define an annular, longitudinally extending first gas flow passage 36 which surrounds the inner tube 26 and is concentric with the respect to the axis A.

The outer tube 30 likewise has an inner, preferably cylindrical surface which is spaced radially outwardly from an outer, preferably cylindrical surface of the middle tube 28 to define an annular, longitudinally extending second gas flow passage 38 which is disposed concentrically about the first gas flow passage 36 and separated therefrom by the middle tube 28.

The nozzle assembly 10 includes a tubular tail piece support 40 which mounts and supports the tubes 26, 28, 30 in their concentric, spaced arrangement. The tail piece support 40 has a stepped inner bore 42 with an inner portion 44 aligned with and forming an extension of the central passage 32 of the inner tube 26 to provide lateral support and guidance to the wire 20 within the nozzle assembly at the top end 50 of the nozzle assembly 10.

The upper end of the inner tube 26 is secured at a thread joint 52 within the bore 42 of the tail piece 40. Downstream of the thread joint 52 toward the discharge end 54 of the nozzle assembly, the bore 42 widens and is connected at thread joint 56 to the upper end of the middle tube 28, defining an annular space 58 between the thread joints 52, 56 encircling an extended portion of the inner tube 26 projecting from the middle tube 28 and an open flow communication with the first gas flow passage 36 formed between the middle tube 28 and inner tube 26.

Below the thread joint 56, the bore 42 further widens so as to be spaced radially from the outer surface of the middle tube 28. A tubular tail piece extension 60 is fixed in gas-tight relation to the upper end of the outer tube 30, which is spaced axially from the thread joint 52. The tail piece extension 60 is releasably coupled by a thread joint 62 to the main body of the tail piece support 40. The bore 42 of the tail piece 40 is open between the thread joint 56 and the upper end of the outer tube 30, defining an annular space 64 therebetween and circling the extended portion of the middle tube 28 projecting beyond the end of the outer tube 30 and an open flow communication with the second gas flow passage 38.

Figure 2:
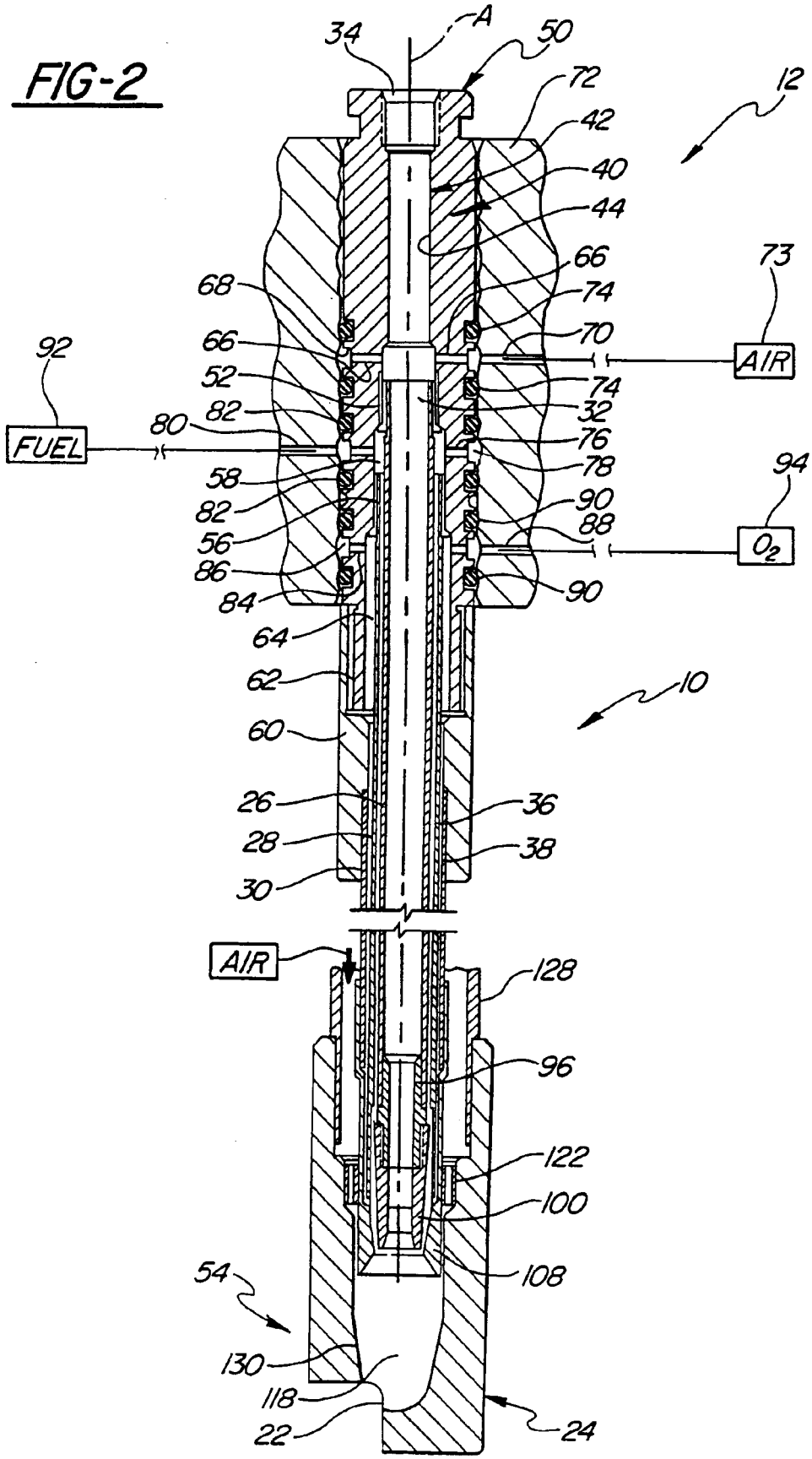
FIG. 2 is a fragmentary cross-sectional view of an HVOF nozzle constructed according to the invention.

As shown best in FIG. 2, the tail piece 40 is formed with at least one and preferably a plurality of a first set of circumferentially spaced openings 66 extending radially inwardly through the wall of the tail piece 40 and communicating with the bore 42 of the tail piece 40 at a location above the upper end of the inner tube 26 so as to be in open flow communication with the passage 32 of the inner tube 26, but isolated by the thread joint 52 from the gas flow passages 36, 38. The openings 66 extend to an annular groove 68 formed in the tail piece 40. The groove 68 communicates with an air infeed passage 70 provided in a stationary support 72 which surrounds the upper portion of the nozzle assembly 10 about its axis A. The air infeed passage 70 communicates with a source of pressurized air 73. The groove 68 is sealed on either side by a set of O-rings 74 to seal the passage 70 against leakage. The infed air serves to pressurize the wire feed passage 32 to effectively seal the passage 32 against the back flow of combustion gases during operation.

The tail piece support 40 is formed with at least one and preferably a second set of a plurality of circumferentially spaced openings 76 communicating with the annular space 58 and with an annular groove 78 and fed by at least one gas flow passage 80 provided in the stationary support 72 for supplying a flow of fuel gas to the first gas flow passage 36. A set of O-rings 82 arranged on opposite sides of the groove 78 seal the passages against leakage.

The tail piece 40 preferably includes at least one and preferably a third set of a plurality of circumferentially spaced, radially inwardly extending openings 84 communicating with the annular space 64 and with an annular groove 86 and fed by at least one gas flow passage 88 provided in the stationary support 72, and sealed on opposite sides of the groove 86 by a set of O-rings 90, for supplying a flow of gas to the second gas flow passage 38. Preferably, the first gas flow passage 36 is operatively coupled to a source of gaseous fuel 92, which may comprise any of a number of gaseous fuels, such as propane, propylene, natural gas, etc. The second gas flow passage 38 preferably communicates with a source of oxygen 94. As the gaseous fuel 92 and oxygen 94 enter in flow along the first and second gas flow passages 36, 38, they are kept separate by the intervening middle tube 28 and thus do not mix along the substantial length of the nozzle assembly 10. However, toward the discharge end 54, the gases do come together and do mix prior to entry into the combustion chamber in the manner now to be described.

Figure 3:
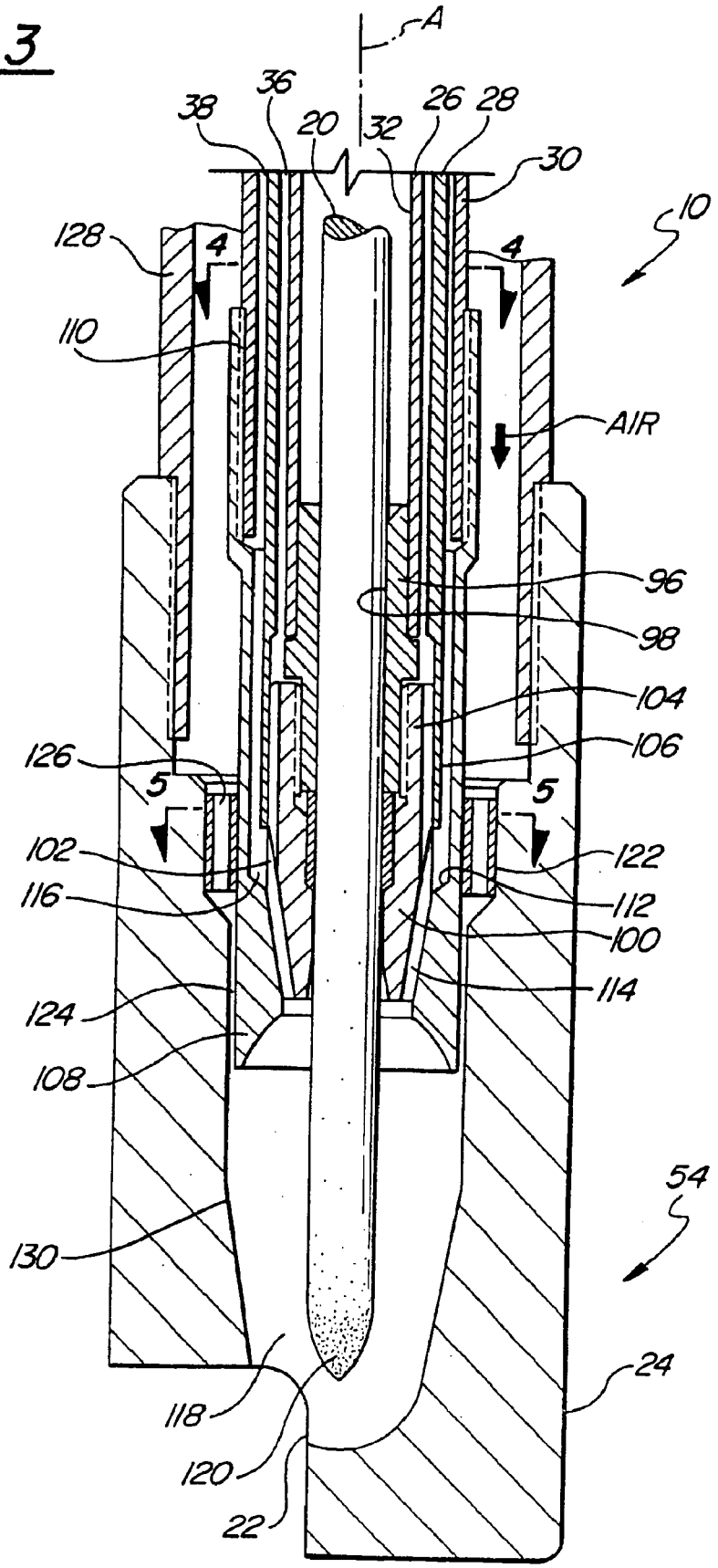
FIG. 3 is an enlarged fragmentary sectional view of the nozzle shown with an air cap.
Figure 4:
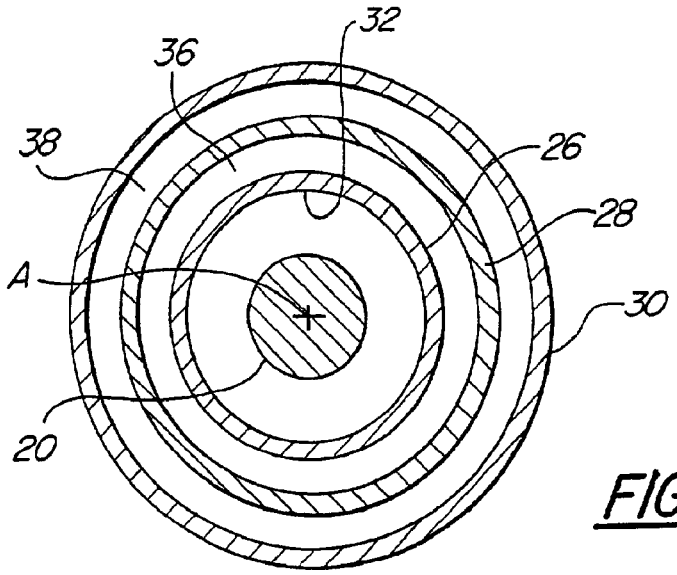
FIG. 4 is a cross-section taken generally along lines 4—4 of FIG. 3.

As best shown in FIG. 3, the inner tube 26 is fitted at its opposite end with a wire guide 96 having a reduced diameter bore 98 to provide close fit guided support to the feed wire 20 adjacent the discharge end 54. The wire guide 96 projects beyond the distal end of the inner tube 26 and mounts a nib 100. The nib 100 is formed on its outer surface with a plurality of circumferentially-spaced, longitudinally extending slots 102 set preferably at about a 6–20 degree converging angle toward the discharge end 54. An upper end 104 of the nib 100 extends into the distal end 106 of the middle tube 26 in tight fitting relation thereto, such that only the fuel gas 92 from the first gas flow passage 36 is introduced into the slots 102 at the upper end 104 and is shielded from mixing with the oxygen gas over the portion of the length of the slots 102 that is shrouded by the intermediate tube 28. However, the outer tube 30 is fitted with a tubular plug 108 which is secured to the outer tube 30 at its upper end by a thread joint 110 and extends in prolongation of the outer tube 30 over the intermediate tube 28 in radially outwardly spaced relation thereto so as to provide an extension of the second gas flow passage 38 beyond the distal end 106 of the middle tube.

The plug 108 is formed with an annular shoulder 112 spaced axially downstream from the distal end 106 of the middle tube 28, at which point the plug 108 tapers inwardly to engage a distal mixing end portion 114 of the slots 102 downstream of the shoulder 112. Between the shoulder 112 and the distal end 106 there is formed an axially extending annular space 116 encircling the outer surface of the nib 100 in an open flow communication with the slots 102 of the nib as well as the first and second gas flow passages 36, 38. This annular space 116 upstream of the mix end portion 114 serves as an annular premix chamber where the previously separated gases exiting the first and second gas flow passages 36, 38 beyond the distal end 106 of the middle tube 28 come together and are partially but not fully mixed in a turbulent atmosphere of the space 116 caused by the gas flow and the geometry of the space, including the abrupt shoulder 112, prior to entry of the partially mixed gases into the mix end portion 114 of the slots 102 where full mixing occurs, such that the gases exiting the nib are fully mixed. The pre-mix zone 116 serves to provide a partial mixing of the gases which is advantageous for efficient downstream mixing and combustion, while serving as a buffer zone to minimize or prevent flashback of the burning gases into the nozzle assembly from the combustion chamber 118 downstream of the nozzle assembly 10. Should conditions arise where the mixed gases in the nib 100 combust, it is easily eliminated by altering the gas flow to effectively blow the flame back out of the nib. The incomplete mixing in the premix zone 116 prevents the zone 116 from serving as a flame catcher, which would hold the flame within the nozzle assembly and cause possible overheating and damage if not eliminated. The present construction minimizes the detrimental effects of such flashbacks and, when properly operating, eliminates flashbacks to the extent that they might cause damage to the nozzle assembly 10.

The mixed gases exiting the nib slots 114 enter a combustion chamber 118 formed within the air cap 24 installed on the distal end of the outer tube 30. As shown best in FIG. 3, the feed wire 20 is fed through the bore 98 of the guide 96, presenting a tip end 120 of the feed wire 20 in the combustion chamber 118. The ignited combustion gases are burning at temperatures exceeding the melting point of the feed material 20 so as to quickly melt and to some degree burn the tip end 120 causing the feed material to stream off the end of the wire tip 120 as a ligament of molten material which is carried by the combustion gas stream toward the air cap exit opening 22 where the molten material is atomized and accelerated radially outwardly for coating the walls of the bore.

It is preferred that the air cap 24 be fitted to the outer tube 30 in such manner as to accommodate a flow of air into the combustion chamber to form a protective boundary layer of air against the walls of the chamber during operation. The boundary layer operates to cool the walls of the chamber during operation, and serves to minimize or prevent the atomized wire feed material from applying itself to the walls of the combustion chamber 118. Instead, the flowing boundary layer of air moves the material across the surface and out through the opening 22. By reducing the heat and the sticking of wire feed material to the combustion chamber walls, the cost of maintenance and replacement of the air cap is greatly reduced.

Figure 5:
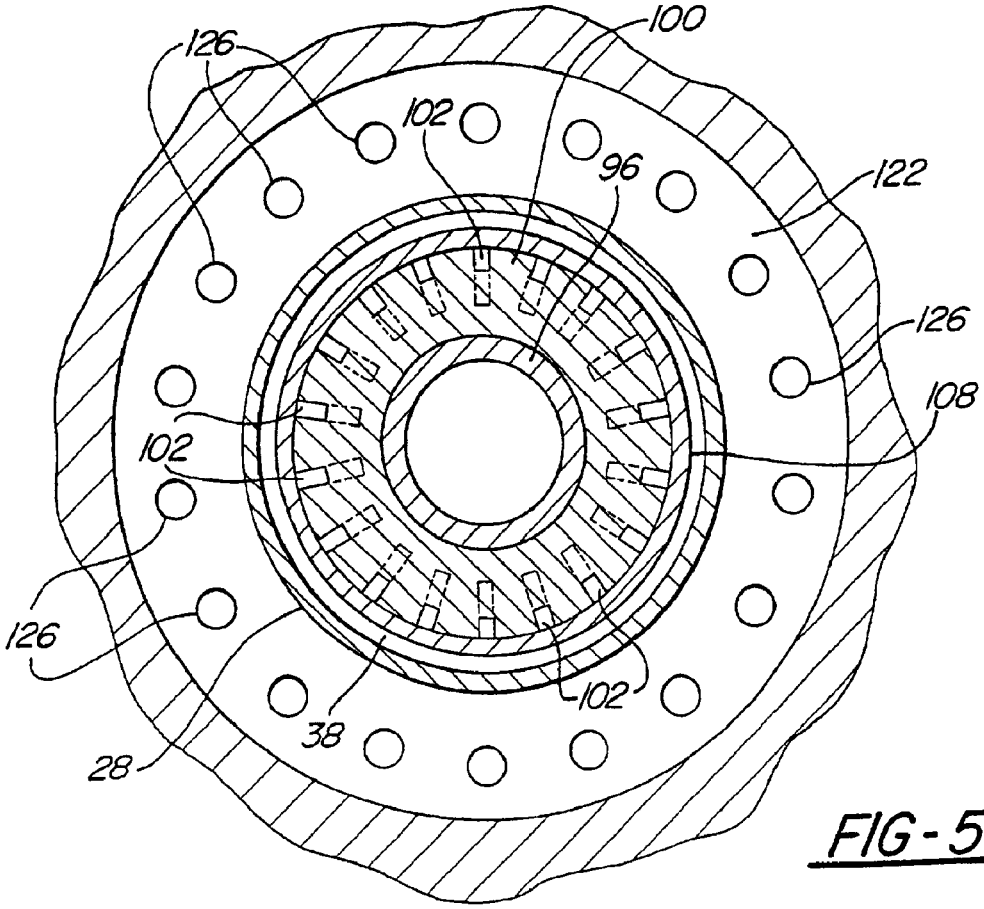
FIG. 5 is a cross-section taken generally along lines 5—5 of FIG. 3.

As shown best in FIGS. 3 and 5, the air cap 24 is preferably support an allowed to rotate around the nozzle 10 by a porous bushing 122 which is disposed about the plug 108 on its inner diameter surface and mounts the air cap 24 about its outer diameter, defining an annular air gap 124 between an outer cylindrical surface of the outer tube 30 (or its plug extension 108) and an inner cylindrical surface of the air cap 24 which open to the combustion chamber 118 and axially downstream of the bushing 122. The bushing 122 is formed with at least one and preferably a plurality of openings 126 to provide for the passage of air delivered at a predetermined flow rate through an annular space formed by the inner diameter of the rotating extension tube 128 and the outer diameter of the outer tube 30 of the nozzle 10 into the air gap 124 through the bushing 122. The concentric cylindrical walls of the air gap 124 sets up a column of air which flows along and parallel to the inner surface 130 of the air cap 24. The column of air is maintained across the entirety of the inner surface 130 to protect the air cap 24 and exits the air cap 24 through the opening 22. As also shown in FIG. 3, the walls of the combustion chamber are curvilinear and without any abrupt changes in dimension or direction that would disturb the maintenance of the protective boundary layer, including any undercuts or pockets adjacent the opening 22 or other features that would effec tively form an eddy that would disturb the flow of the boundary layer. The air also mixes with the combustion gases to some degree and reacts with the feed material to assist in the consumption of the feed wire.

Obviously, many modifications and variation of the present invention are possible in light of the above teachings. It is, therefore, to be understood that within the scope of the appended claims, the invention may be practiced otherwise than as specifically described. The invention is defined by the claims.

What is claimed is:

1. A nozzle assembly for a high velocity oxygen fuel (HVOF) thermal metallic spray coating apparatus, said nozzle assembly comprising:

an inner tube extending longitudinally along an axis and defining a feed passage for a feed wire of metallic spray coating material;

an outer tube disposed concentrically about said inner tube; and an intermediate tube disposed concentrically between and spaced radially from said inner and outer tubes to define a pair of concentric annular longitudinally extending gas flow passages for oxygen and gaseous fuel wherein said inner tube mounts a longitudinally slotted nib at a discharge end of the nozzle assembly and said outer tube mounts a plug engaging said nib to define an array of circumferentially spaced longitudinally extending slots at said discharge end of said nozzle.

2. The nozzle assembly of claim 1 wherein one of said gas flow passages is coupled to a source of oxygen and the other of said gas flow passages is coupled to a source of gaseous fuel.

3. The nozzle assembly of claim 1 wherein said intermediate tube extends over a portion of said slots and defines the start of a premix zone downstream of said intermediate tube where the oxygen and fuel streams come together and partially mix within the slots between said nib and said plug before exiting slots into the combustion chamber where complete mixing occurs.

4. The nozzle assembly of claim 1 wherein said nozzle includes a discharge end and an air cap coupled to said discharge end having a radially directed outlet.

5. The nozzle assembly of claim 1 wherein said tubes are rotatable about said axis.

6. A nozzle assembly for a high velocity oxygen fuel (HVOF) thermal metallic spray coating apparatus, comprising:

a set of tubes for delivering combustible oxygen, fuel gases and a feed wire to a combustion zone of said apparatus, said set of tubes including an outer tube having an outer cylindrical surface adjacent said combustion zone;

an air cap fitted to said outer tube having an inner wall surface defining said combustion zone when the feed material is melted by reaction of the combustion gases and expelled at high velocity from said air cap through a discharge opening therein; and wherein a portion of said air cap extends over said outer tube in radially outwardly spaced relation thereto to define an annular cylindrical air gap between said inner surface of said air cap and said cylindrical outer surface of said outer tube, said air gap coupled to a source of high velocity air for developing a column of air within said air gap which travels along said air cap toward said discharge opening and provides a boundary of air flowing along said inner surface of said air cap to protect said inner surface from exposure to the heat of the combustion chamber flame and molten metal feed wire material.

7. The apparatus of claim 6 including a porous bushing disposed between said air cap and said inner tube to maintain concentricity and permit rotation.

* * * * *